United States Patent [19]

Agsten et al.

[11] Patent Number: 4,555,883

[45] Date of Patent: Dec. 3, 1985

[54] HOOP BEAM EQUIPPED PRECAST SILO CONSTRUCTION

[76] Inventors: Carl F. Agsten, 1539 Bedford Rd., Charleston, W. Va. 25314; Willis C. Haworth, 3515 Staunton Ave., Charleston, W. Va. 25304

[21] Appl. No.: 524,239

[22] Filed: Aug. 18, 1983

[51] Int. Cl.[4] ..... E04H 12/28

[52] U.S. Cl. ..... 52/245; 52/248

[58] Field of Search ..... 52/198, 224, 245, 247, 52/248, 192

[56] References Cited

U.S. PATENT DOCUMENTS

| | | | |
|---|---|---|---|
| 741,403 | 10/1903 | Hubbard | 52/248 X |
| 1,086,295 | 2/1914 | Hillman | 52/248 X |
| 2,260,307 | 10/1941 | Ferris | 52/248 X |
| 2,365,891 | 12/1944 | McLaughlin, Jr. | 52/248 X |
| 2,853,744 | 9/1958 | Wallace | 52/248 X |

FOREIGN PATENT DOCUMENTS

| | | | |
|---|---|---|---|
| 221262 | 10/1961 | Austria | 52/248 |
| 1488458 | 11/1961 | France | 52/224 |

*Primary Examiner*—Carl D. Friedman
*Assistant Examiner*—Creighton Smith
*Attorney, Agent, or Firm*—Harvey B. Jacobson

[57] ABSTRACT

An upright generally cylindrical bin is provided including a plurality of peripherally spaced upstanding structural members relatively anchored at their lower ends. Each of the structural members includes a horizontally elongated main wall member supported therefrom and extending vertically therealong and which projects outwardly from the structural member in opposite directions toward the peripherally adjacent structural members. Adjacent ends of adjacent main wall members are spaced apart and include bevelled end edges defining, together, an included angle greater than the angle between radial planes of the bin containing those end edges. Elongated horizontal connecting structural members extend between and are anchored relative to adjacent upstanding structural members outwardly of the main wall members and connecting wall members extend between adjacent bevelled end edges of adjacent main wall members and include bevelled end edges complimentary to the bevelled end edges of the adjacent main wall member ends. Threaded fasteners are secured between the connecting structural members and the connecting wall members and draw the connecting wall members outwardly toward the connecting structural members and into wedging engagement between adjacent bevelled ends of adjacent main wall members, compressible seal strips being provided between the complimentary bevelled edges of the main and connecting wall members.

13 Claims, 6 Drawing Figures

HOOP BEAM EQUIPPED PRECAST SILO CONSTRUCTION

BACKGROUND OF THE INVENTION

Various different forms of silos and other storage bins heretofore have been constructed of preformed components, but many of these previously known storage bins and silos have been difficult and expensive to erect. Further, various different forms of seal structures have been used between adjacent preformed components in the structure of storage bins and silos and many of these previous seal structures have not proven efficient.

Accordingly, a need exists for an improved form of storage bin or silo to be constructed of preformed components and in a manner whereby effective seals may be utilized between adjacent edges of preformed components.

Examples of different forms of storage bins and silos including some of the general structural and operational features of the instant invention are disclosed in U.S. Pat. Nos. 1,750,052, 2,074,592, 2,361,272, 4,126,976 and 4,308,967.

BRIEF DESCRIPTION OF THE INVENTION

The bin construction of the instant invention is generally cylindrical in configuration, an upwardly or downwardly tapering bin also could be provided. In addition, the bin construction could also include an hourglass shape, if desired.

The bin includes a plurality of peripherally spaced upright structural members relatively anchored at their lower ends and each upright structural member includes a main wall member supported from the inner side thereof and extending vertically therealong. The main wall members are horizontally elongated and include end edges which are bevelled in a manner to form, together, an inclined angle greater than the included angle between radial planes radial planes of the bin containing the end edges. Further, the end edges of adjacent main wall members are peripherally spaced apart and elongated horizontal peripheral structural members extend and are anchored between adjacent upright structural members. Horizontally elongated connecting wall members extend between each pair of adjacent main wall member ends and the ends of the connecting wall members are also bevelled so as to be complimentary to the opposing bevelled main wall end edges. Threaded bolts or other similar fasteners are secured between each elongated horizontal peripheral structural member and the corresponding connecting wall member and are utilized to tightly seat each connecting wall member between the adjacent ends of the corresponding main wall members, elongated upstanding seal strips being provided provided between each pair of opposing complimentary bevelled main and connecting wall members.

The bin may include vertically stacked horizontal courses of main and connecting wall members and the opposing surfaces between vertically stacked main and connecting wall members may be complementarily stepped and include horizontal seal strips therebetween. In this manner, the weight of each upper course of main and connecting wall members will compress the seal strips between vertically adjacent courses of main and connecting wall members and the threaded fasteners supporting the connecting wall members from the peripheral structural members may function to compress the upstanding seal strips between the complimentarily bevelled opposing end edges of main and connecting wall members.

The main object of this invention is to provide a storage bin, silo, cooling tower or other similar structure of preformed components.

Another object of this invention is to provide a structure in accordance with the preceding object and including structural features whereby both horizontal and vertical seal strips between opposing horizontal and vertical edges of adjacent wall portions of the structure may be effective to form the desired seal.

Still another object of this invention is to provide a structure which may be more readily assembled.

Still another important object of this invention is to provide a structure whose size may be varied merely by varying the horizontal length of two different components thereof comprising the horizontally elongated peripheral structural members and the horizontally elongated connecting wall members.

A final object of this invention to be specifically enumerated herein is to provide a structure in accordance with the preceding objects and which will conform to conventional forms of manufacture, be of simple construction and easy to erect so as to provide a device which will economically feasible, long lasting and relatively trouble free in final erection.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
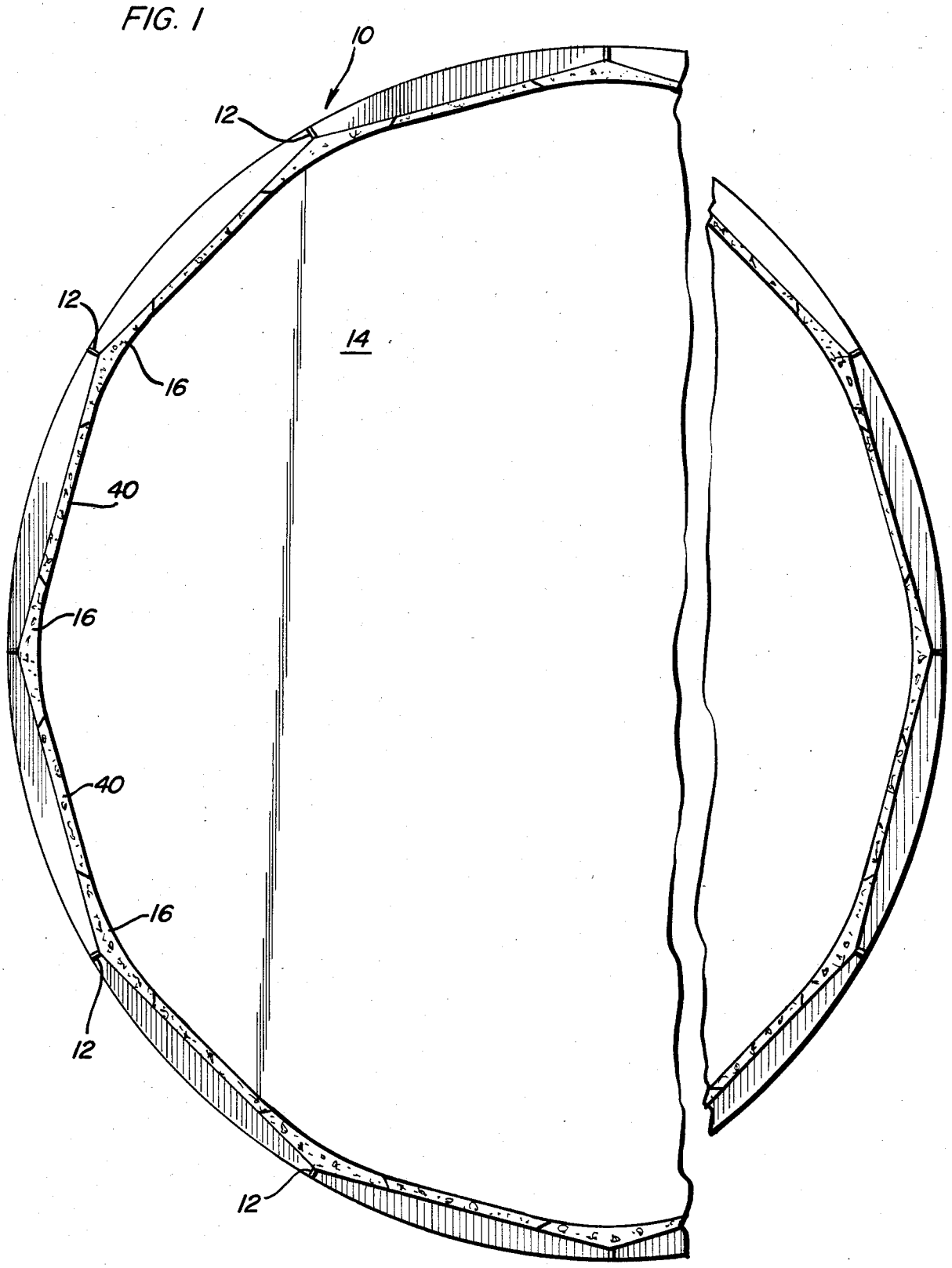
FIG. 1 is a fragmentary horizontal sectional view of the bin structure of the instant invention.

Referring now more specifically to the drawings, the numeral 10 generally designates the storage bin, silo, cooling tower or other structure of the instant invention. The structural 10 includes a plurality of peripherally spaced upstanding elongated structural members 12 which have their lower ends anchored relative to a base or floor 14 in any convenient manner.

Each of the upstanding structural members 12 includes a horizontally elongated main wall member 16 supported therefrom including opposite end bevelled edges 18 which together form an included angle greater than the included angle formed by radial planes of the structure 10 containing the opposite ends of the main wall member. In addition, horizontally elongated peripheral structural members 20 are connected between each pair of adjacent structural members 12 and include substantially planar inner sides 22 against which adjacent ends of adjacent main wall members 16 abut and may be secured by suitable fasteners 24 anchored in the main wall members 16 and secured through the inner side or flange 22 of the corresponding peripheral structural member 20 by nuts 26.

Figure 6:
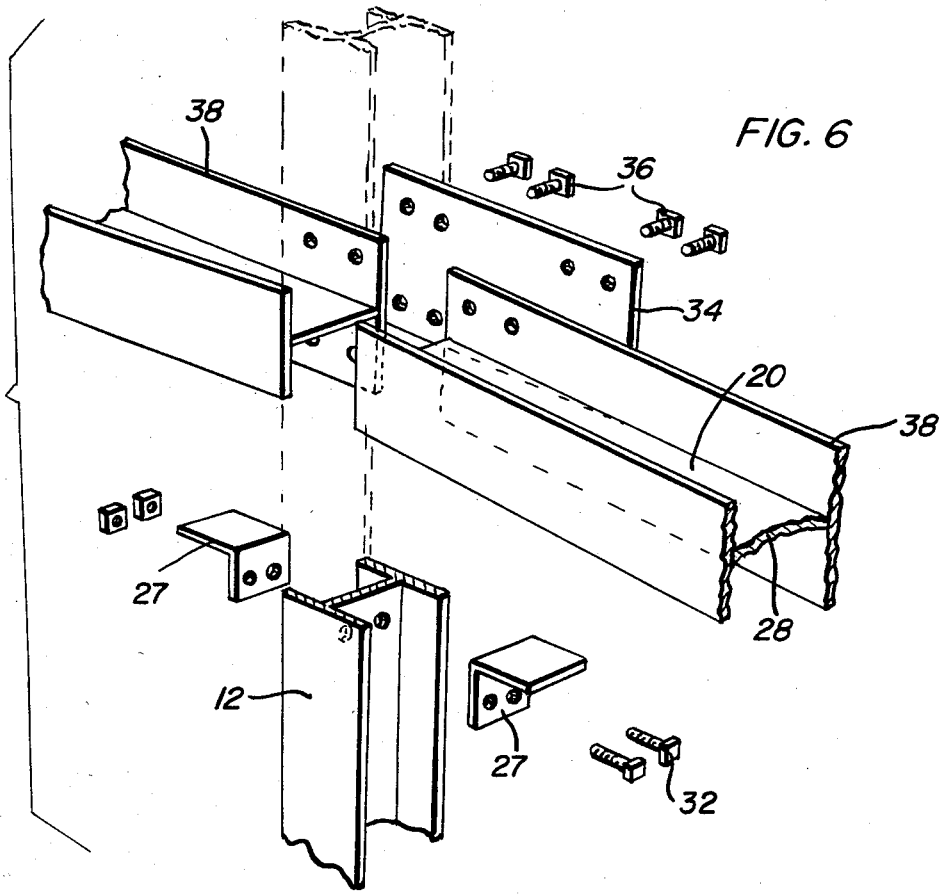
FIG. 6 is an exploded perspective view illustrating a typical connection between vertically spaced upstanding structural members and peripherally adjacent horizontal structural members of the structural grid which supports the wall members of the bin.

From FIG. 6 of the drawings, it may be seen that the structural members 12 comprise I-beams and that the peripheral structural members 20 also have the cross-sectional shape of an I-beam. Angle brackets 27, welded or otherwise secured to the underside of the horizontal web portions 28 of the peripheral structural members 20, are secured by fasteners 32 through the web portion of the corresponding structural member 12 and lap plates 34 are secured by fasteners 36 over the outer flanges 38 of adjacent ends of adjacent peripheral members 20.

In addition to the main wall members 16, connecting wall members 40 are also provided and are horizontally elongated. The connecting wall members 40 extend between adjacent ends of adjacent main wall members 16 and include bevelled end edges 42 which are complimentary to the bevelled end edges 18 of the main wall members 16. In addition, further fasteners 24 are anchored relative to the connecting wall members 40 and secured by nuts 26 through the inner flange 22 of the corresponding peripheral structural member 20.

Figure 2:
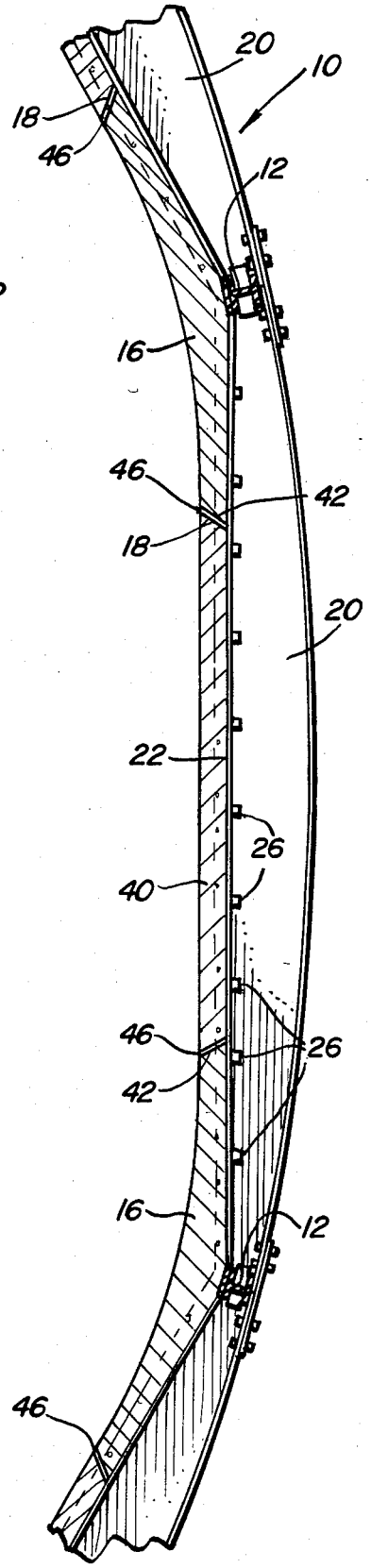
FIG. 2 is an enlarged horizontal sectional view of one peripheral wall portion of the bin structure.
Figure 3:
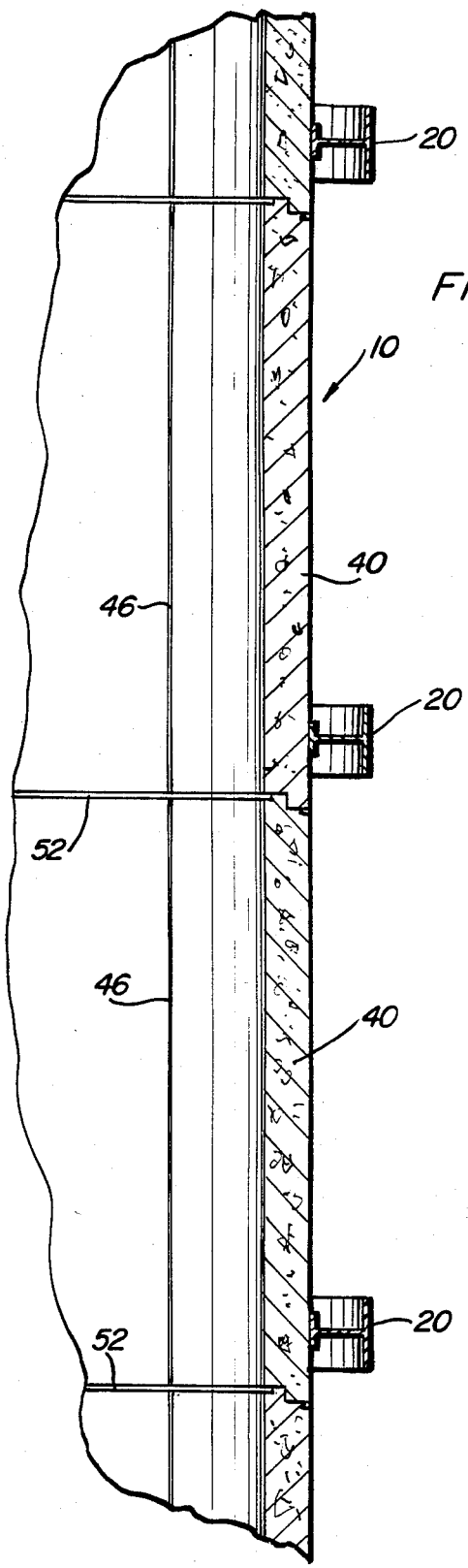
FIG. 3 is an enlarged fragmentary vertical sectional view illustrating the stepped joint between adjacent courses of wall members of the structure.

The bevelled edges 42 of each main wall member 16 form an included angle greater than the included angle between radial planes of the bin 10 containing those bevelled edges, whereby the complementary bevelled edges 18 may wedgingly seat thereagainst, see FIG. 2.

Figure 4:
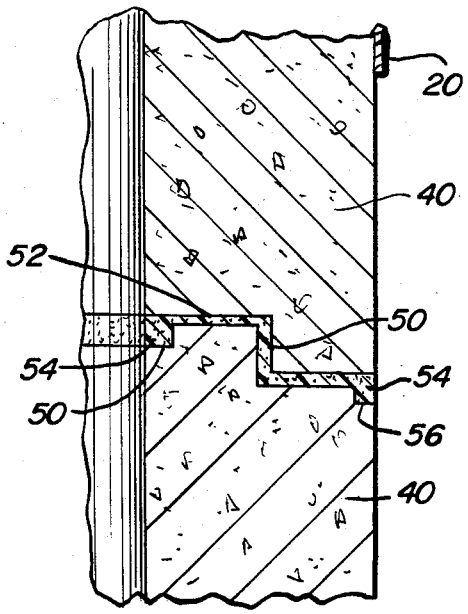
FIG. 4 is a further fragmentary enlarged vertical sectional view of the joint between vertically adjacent wall members of the structure.
Figure 5:
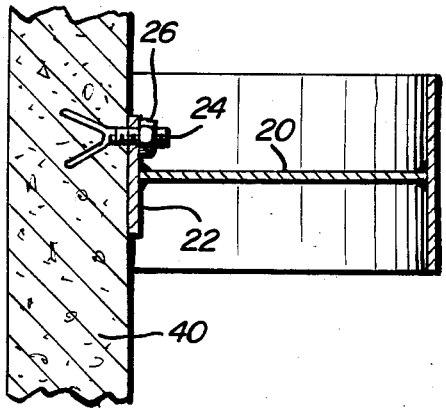
FIG. 5 is a fragmentary enlarged vertical sectional views illustrating the manner in which the connecting wall members may be finally drawn into position against the elongated horizontal peripheral structural members.

As the connecting wall members 40 are drawn into final seated engagement with the inner flanges 22 of the connecting structural members 20, vertical seal strips 46 disposed between complimentary bevelled end edges 18 and 42 are compressed therebetween. Further, the structure 10 includes vertically stacked courses of wall members 16 and 40 and vertically stacked sets of structural members 12 and 20 with the opposing upper and lower edges of vertically stacked lower and upper wall members 16 and 40 being stepped as at 50 and having horizontal peripheral seal strips 52 compressively engaged therebetween, the seal strips 52 including inner and outer marginal ribs 54 seated in inner and outer marginal notches 56 formed in the upper edges of the wall members 40 and 16, see FIG. 4.

Any suitable structure may be utilized to close the upper end of the structure 10, if desired and the wall members 16 and 40 may be precast and reinforced with conventional reinforcing steel, or they may be pre-stressed in their long or vertical axis. Pre-stressing is greatly preferred because it allows thinner, lighter wall members to resist the forces placed thereon and also reduces shrinkage in height that occurs in all tall concrete structures due to the concrete's own weight.

The number of columns formed by the structural members 12 is a random choice and could be determined by manufacturing conditions. For any given number of columns, the diameter of the structure 10 may be varied merely by changing the length of the connecting wall members 40 and the peripheral structural members 20. The structural members 20 form hoop beams extending about the structure 10 and the cross-sectional shape of the hoop beams may be varied. Further, the structure 10 may be used for storage silos, tanks, shallow bins, retention basins and also possibly cooling towers as well as other uses.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An upright generally cylindrical structure including a plurality of peripherally spaced upstanding structural members relatively anchored at their lower ends, each structural member including an upstanding horizontally elongated main wall member supported therefrom and extending vertically therealong, said main wall members projecting horizontally laterally from the corresponding structural member in opposite directions toward the peripherally adjacent structural members, adjacent ends of said main wall members being spaced apart, horizontally elongated peripheral structural members anchored relative to and extending between adjacent upstanding structural members closely outwardly of said main wall members, the end edges of each of said main wall members being bevelled and together forming an included angle greater than the included angle between radial planes of said cylindrical structure containing said end edges, connecting wall members extending between adjacent spaced end edges of said main wall members and including bevelled end edges corresponding to the bevelled end edges of said main wall members, and fastener means connected between said connecting wall members and said peripheral structural members operative to draw said connecting wall members outward toward said peripheral structural members and into seated position between adjacent bevelled edges of said main wall members.

2. The cylindrical structure of claim 1 wherein said fastener means comprise threaded fastener means.

3. The cylindrical structure of claim 2 wherein said fastener means include threaded shank-type members anchored in and projecting outwardly from the outer sides of said main wall members.

4. The cylindrical structure of claim 1 including vertical seal strips compressively engaged between opposing complimentary bevelled edges of said main and connecting wall members.

5. The cylindrical structure of claim 1 wherein said wall members comprise pre-stressed concrete wall members.

6. The cylindrical structure of claim 1 wherein said structure includes vertically stacked horizontal courses of main and connecting wall members and each of said courses includes separate upstanding structural members and peripheral structural members with the lower ends of the upstanding structural members of each upper course supported from the upper ends of the upstanding structural members of the next lower course.

7. The cylindrical structure of claim 6 wherein the lower marginal edges of the main and connecting wall members of each upper course and the upper marginal edges of the main and connecting wall members of the next lower course are complimentarily stepped, and horizontal peripheral seal strip means interposed between said stepped lower and upper marginal edges.

8. The cylindrical structure of claim 7 wherein said fastener means comprise threaded fastener means.

9. The cylindrical structure of claim 8 wherein said fastener means include threaded shank-type members anchored in and projecting outwardly from the outer sides of said wall members.

10. The cylindrical structure of claim 7 including vertical seal strips compressively engaged opposing complimentary bevelled edges of said main and connecting wall members.

11. An upright generally cylindrical structure including a plurality of peripherally spaced upstanding horizontally elongated main wall members, adjacent ends of said main wall members being spaced apart, peripherally about said structure, horizontally elongated peripheral structural members anchored relative to and extending between adjacent main wall members, the end edges of each of said main wall members being inwardly bevelled and together forming an included angle greater than the included angle between radial planes of said cylindrical structure containing said end edges, connecting wall members extending between adjacent spaced end edges of said main wall members and including bevelled end edges corresponding to the bevelled end edges of said main wall members, and fastener means connected between said connecting wall members and said peripheral structural members operative to draw said connecting wall members outward toward said peripheral structural members and into wedging seated engagement with and between adjacent bevelled edges of said main wall members.

12. The cylindrical structure of claim 11 including vertical seal strips compressively engaged between opposing complementary bevelled edges of said main and connecting wall members.

13. The cylindrical structure of claim 11 wherein said wall members comprise pre-stressed concrete wall members.

* * * * *